US011344995B2

(12) United States Patent
Matsumoto

(10) Patent No.: US 11,344,995 B2
(45) Date of Patent: May 31, 2022

(54) SHOT PROCESSING DEVICE AND SHOT PROCESSING METHOD

(71) Applicant: SINTOKOGIO, LTD., Nagoya (JP)

(72) Inventor: Masato Matsumoto, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 67 days.

(21) Appl. No.: 16/762,977

(22) PCT Filed: Oct. 10, 2018

(86) PCT No.: PCT/JP2018/037782
§ 371 (c)(1),
(2) Date: May 11, 2020

(87) PCT Pub. No.: WO2019/106968
PCT Pub. Date: Jun. 6, 2019

(65) Prior Publication Data

US 2020/0269387 A1 Aug. 27, 2020

(30) Foreign Application Priority Data

Nov. 30, 2017 (JP) ..... JP2017-230014

(51) Int. Cl.
*B24C 1/10* (2006.01)
*B24C 3/04* (2006.01)
*B24C 3/14* (2006.01)

(52) U.S. Cl.
CPC ..... *B24C 1/10* (2013.01); *B24C 3/04* (2013.01); *B24C 3/14* (2013.01)

(58) Field of Classification Search
CPC .... B24C 1/10; B24C 3/04; B24C 3/14; B24C 3/32; B24C 5/06; B24C 9/00
See application file for complete search history.

(56) References Cited

U.S. PATENT DOCUMENTS 5,782,677 A 7/1998 Kanouse
2014/0087634 A1* 3/2014 Asahi ..... B65G 1/04 451/38

FOREIGN PATENT DOCUMENTS

CN 101992427 A 3/2011
CN 102001028 A 4/2011
(Continued)

OTHER PUBLICATIONS

Machine Translation of Lee, KR101286451B1, Jul. 16, 2013 (Year: 2013).*

(Continued)

*Primary Examiner* — Ryan J. Walters
(74) *Attorney, Agent, or Firm* — Faegre Drinker Biddle & Reath LLP

(57) ABSTRACT

A shot processing device according to an aspect includes: a guide portion provided in a conveyance direction of a workpiece; a rotation mechanism which includes a first endless belt providing a placement surface having the workpiece placed thereon and a first drive unit driving the first endless belt so that the placement surface moves in a direction opposite to the conveyance direction; a conveyance mechanism which pushes the workpiece toward the conveyance direction so that the workpiece on the placement surface rolls and moves in the conveyance direction along the guide portion; and at least one projector which projects shot media to the workpiece rolling and moving on the placement surface.

14 Claims, 11 Drawing Sheets

(56) References Cited

FOREIGN PATENT DOCUMENTS

| | | | |
|---|---|---|---|
| CN | 101992427 | B | 12/2013 |
| CN | 104114325 | A | 10/2014 |
| CN | 105026107 | A | 11/2015 |
| CN | 106457517 | A | 2/2017 |
| CN | 206287025 | U | 6/2017 |
| CN | 107081683 | A | 8/2017 |
| CN | 206379848 | U | 8/2017 |
| JP | S51-52392 | U | 4/1976 |
| JP | 2015-134679 | A | 7/2015 |
| JP | 2016-036864 | A | 3/2016 |
| KR | 10-1286451 | B1 | 7/2013 |
| WO | WO-2013/121975 | A1 | 8/2013 |
| WO | WO-2016/009805 | A1 | 1/2016 |

OTHER PUBLICATIONS

International Preliminary Report on Patentability dated Jun. 11, 2020 for PCT/JP2018/037782.

* cited by examiner (B)

SHOT PROCESSING DEVICE AND SHOT PROCESSING METHOD

TECHNICAL FIELD

The present invention relates to a shot processing device and a shot processing method.

BACKGROUND ART

Patent Literature 1 below discloses a technique for a disk-shaped product polishing device. In the device described in Patent Literature 1, a disk-shaped product is loaded into a polishing chamber in a standing state. The product loaded into the polishing chamber is conveyed in a conveyance direction in a rolling manner. The product conveyed in a standing state is stopped at a fixed position inside the polishing chamber and is polished in such a manner that shot media are projected thereto while the product is rotated at a desired rotation speed. In this way, in the device described in Patent Literature 1, uneven polishing is suppressed by processing the product in a rotation state.

CITATION LIST

Patent Literature

Patent Literature 1: Japanese Unexamined Utility Model Publication No. S51-52392

SUMMARY OF INVENTION

Technical Problem

However, in the above-described related art, the product corresponding to a workpiece needs to be in a non-conveying state at the time of projecting the shot media to the product in a rotation state.

Thus, there has been a demand for a shot processing device and a shot processing method capable of projecting shot media to a workpiece in a rotation state without stopping the conveyance of the workpiece.

Solution to Problem

A shot processing device according to an aspect includes: a guide portion provided in a conveyance direction of a workpiece; a rotation mechanism which includes a first endless belt providing a placement surface having the workpiece placed thereon and a first drive unit driving the first endless belt so that the placement surface moves in a direction opposite to the conveyance direction; a conveyance mechanism which pushes the workpiece toward the conveyance direction so that the workpiece on the placement surface rolls and moves in the conveyance direction along the guide portion; and at least one projector which projects shot media to the workpiece rolling and moving on the placement surface.

In the shot processing device according to the above-described embodiment, since the workpiece is moved in the conveyance direction while moving the placement surface in a direction opposite to the conveyance direction, the workpiece rolls and moves on the placement surface in the conveyance direction. Then, since the shot media are projected to the workpiece rolling and moving on the placement surface, it is possible to project the shot media while rotating the workpiece without stopping the conveyance of the workpiece.

In an embodiment, the guide portion may be configured to support the workpiece while inclining the workpiece in a direction perpendicular to the conveyance direction and a vertical direction.

In the above-described embodiment, since the workpiece is supported while the workpiece is inclined in a direction perpendicular to the conveyance direction and the vertical direction, it is possible to suppress the workpiece from flapping in a direction perpendicular to the conveyance direction and the vertical direction during conveyance. In another embodiment, at least one projector may include an upper projector provided above a conveyance route of the workpiece.

In an embodiment, the first endless belt may include a plurality of steel plate-shaped members.

According to the above-described embodiment, for example, it is possible to suppress belt consumption due to the projection of the shot media as compared with a case in which the first endless belt is formed of rubber.

In an embodiment, each of the plurality of plate-shaped members may include a surface inclined with respect to a horizontal plane in a direction perpendicular to the conveyance direction and the vertical direction.

In the above-described embodiment, since the plurality of plate-shaped members include surfaces inclined with respect to the horizontal plane, a force to slide on the inclined surface of the steel plate-shaped member acts on the workpiece due to the own weight. Accordingly, since the workpiece is supported by the guide portion in an inclined state, the workpiece hardly falls down and hence the workpiece can be stably supported.

In an embodiment, the shot processing device may further include an unloading chamber to unload the workpiece and the unloading chamber may be provided with an abutting portion which is movable in a direction perpendicular to the conveyance direction and the vertical direction and is able to contact an upper portion of the workpiece disposed in the unloading chamber from a lateral side and a movement mechanism which moves the abutting portion in a direction perpendicular to the conveyance direction and the vertical direction.

In the above-described embodiment, the unloading chamber is provided with the abutting portion which is movable in a direction perpendicular to the conveyance direction and the vertical direction and is able to contact to the upper portion of the workpiece disposed in the unloading chamber from the lateral side. When the abutting portion is moved so as to contact the upper portion of the workpiece from the lateral side, the workpiece can fall down to the lateral side. When the workpiece falls down in the unloading chamber, the shot media adhering to the workpiece can be removed.

In an embodiment, the conveyance mechanism may include a second endless belt which is provided above the placement surface, a second drive unit which drives the second endless belt, and a plurality of pushing portions which are arranged along an outer peripheral surface of the second endless belt and each of the plurality of pushing portions may extend downward from the second endless belt so as to contact the workpiece and push the workpiece in the conveyance direction in response to the driving of the second endless belt so that the workpiece is conveyed toward the conveyance direction. Furthermore, in an embodiment, the shot processing device may further include: a loading mechanism which is provided on the upstream side of the conveyance direction in relation to the placement surface and loads the workpiece onto the placement surface at a predetermined cycle; and a control device which adjusts a drive speed of the second endless belt so that one pushing portion of the plurality of pushing portions is disposed at a position in which the workpiece loaded onto the placement surface is able to be pushed in the conveyance direction in accordance with a timing in which the workpiece is loaded onto the placement surface.

In the above-described embodiment, since the drive speed of the second endless belt is adjusted so that one pushing portion of the plurality of pushing portions is disposed at a position in which the workpiece loaded onto the placement surface can be pushed in the conveyance direction in accordance with a timing in which the workpiece is loaded onto the placement surface, the workpiece can be conveyed with high efficiency.

In an aspect, a shot processing method of projecting shot media to a workpiece using a shot processing device is provided. The shot processing device includes a guide portion provided in a conveyance direction of the workpiece, a rotation mechanism which includes an endless belt providing a placement surface having the workpiece placed thereon and a drive unit driving the endless belt, a conveyance mechanism which conveys the workpiece toward the conveyance direction, and at least one projector which projects shot media to the workpiece. The shot processing method according to an aspect includes: driving the endless belt so that the placement surface moves in a direction opposite to the conveyance direction; pushing the workpiece toward the conveyance direction by the conveyance mechanism so that the workpiece on the placement surface rolls and moves in the conveyance direction along the guide portion; and projecting the shot media from the at least one projector to the workpiece rolling and moving on the placement surface.

In the shot processing method according to the aspect described above, since the workpiece is moved in the conveyance direction while the placement surface is moved in a direction opposite to the conveyance direction, the workpiece rolls and moves on the placement surface in the conveyance direction. Then, since the shot media are projected to the workpiece rolling and moving on the placement surface, it is possible to project the shot media while rotating the workpiece without stopping the conveyance of the workpiece.

Advantageous Effects of Invention

According to an aspect and various embodiments of the present invention, it is possible to project shot media while rotating a workpiece without stopping the conveyance of the workpiece.

BRIEF DESCRIPTION OF DRAWINGS

FIG. 7(A) is a plan view and FIG. 7(B) is a front cross-sectional view.

FIG. 9(A) is a rear view and FIG. 9(B) is a side view.

FIG. 10(A) is a perspective view seen from diagonally below and FIG. 10(B) is a perspective view seen from diagonally above.

DESCRIPTION OF EMBODIMENTS

A shot processing device according to an embodiment will be described with reference to FIGS. 1 to 10. Hereinafter, as illustrated in FIGS. 1 to 9, a description will be made on the assumption that a direction from the front side to the rear side of the shot processing device is the x direction, the up and down direction (the vertical direction) of the shot processing device is the z direction, and a direction orthogonal to the x direction and the z direction is the y direction.

Configuration of Embodiment

Figure 1:
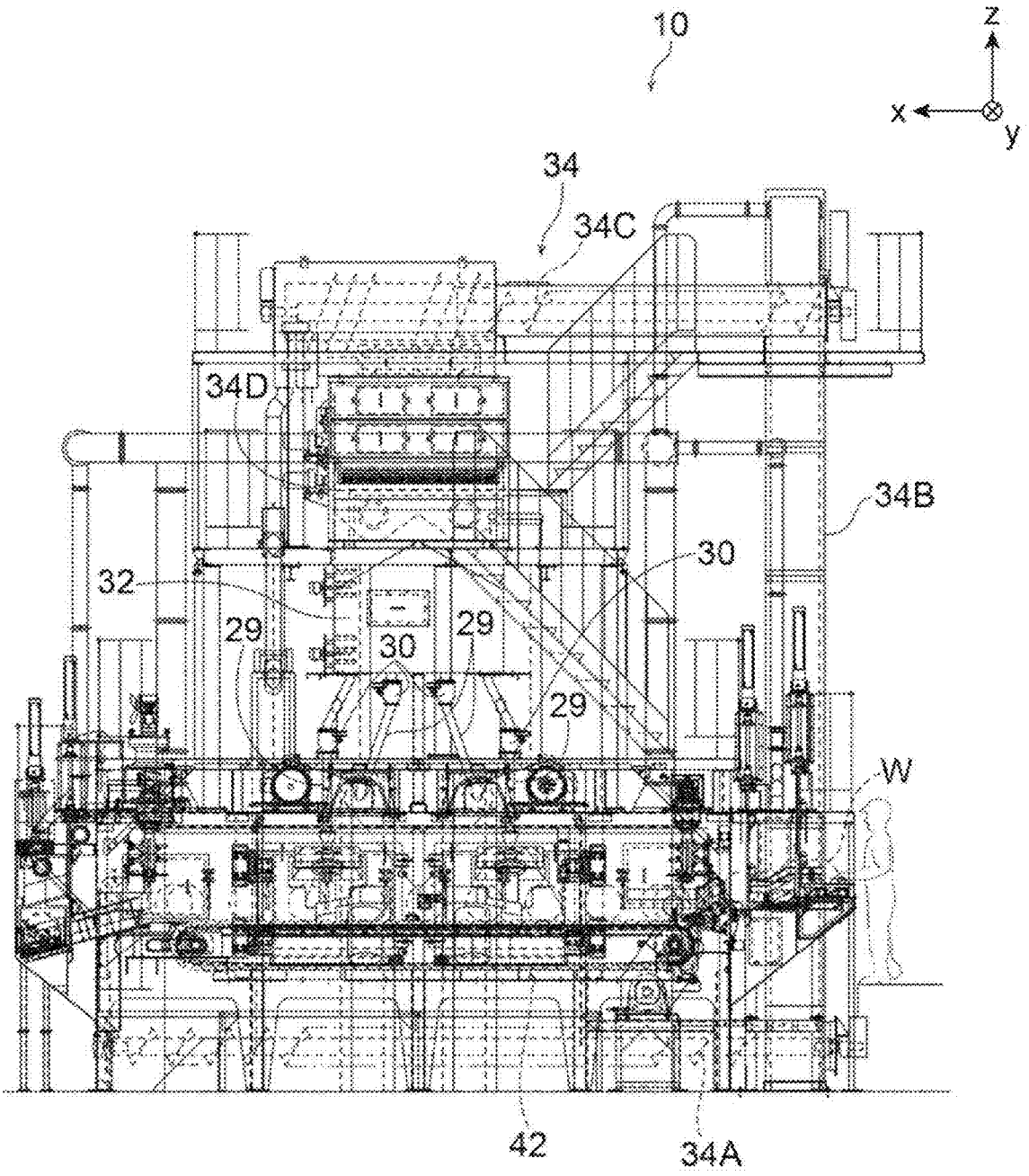
FIG. 1 is a side view illustrating a shot blasting device according to an embodiment.
Figure 2:
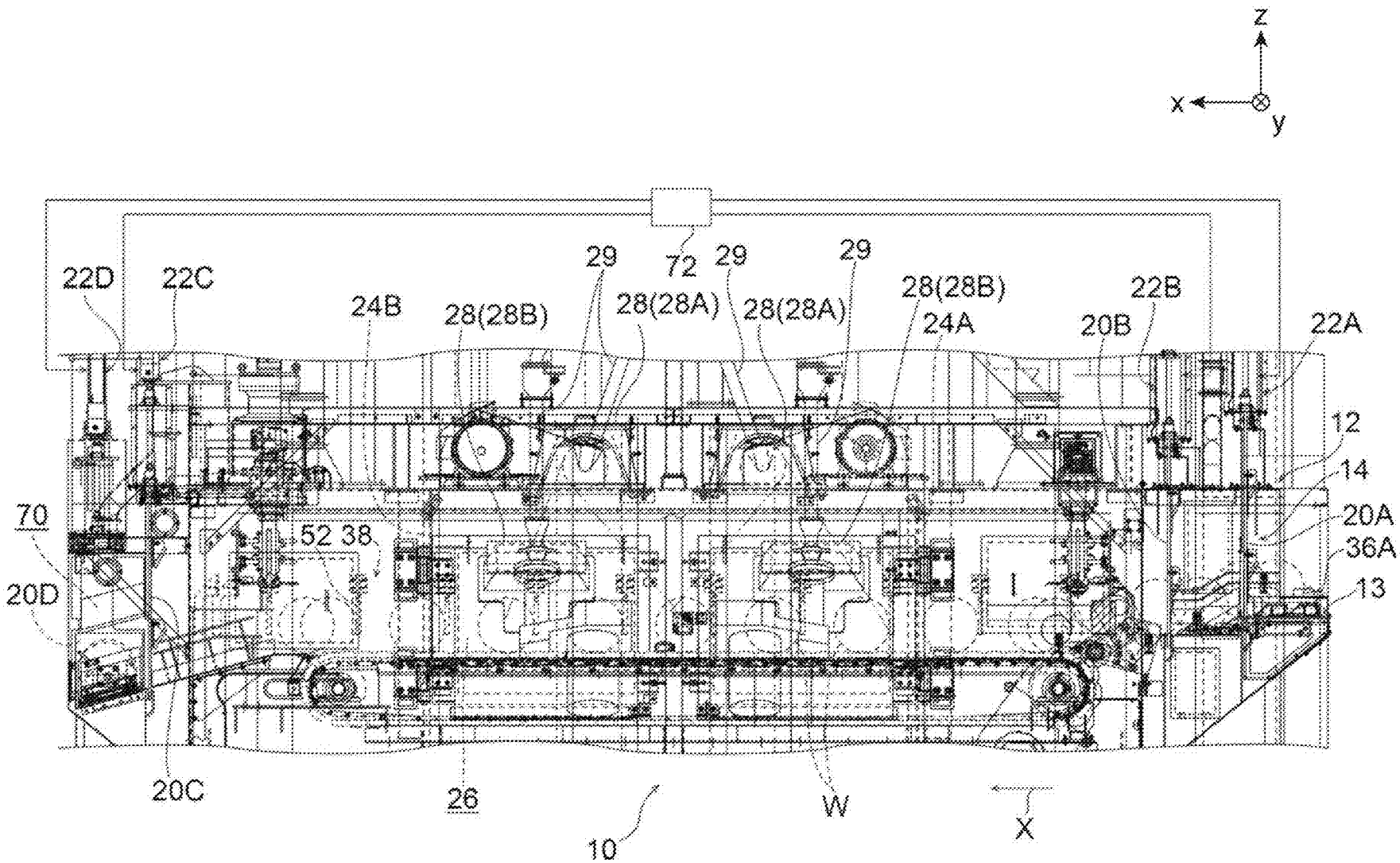
FIG. 2 is a side view illustrating a lower part of the shot blasting device of FIG. 1 in a partially enlarged state.
Figure 3:
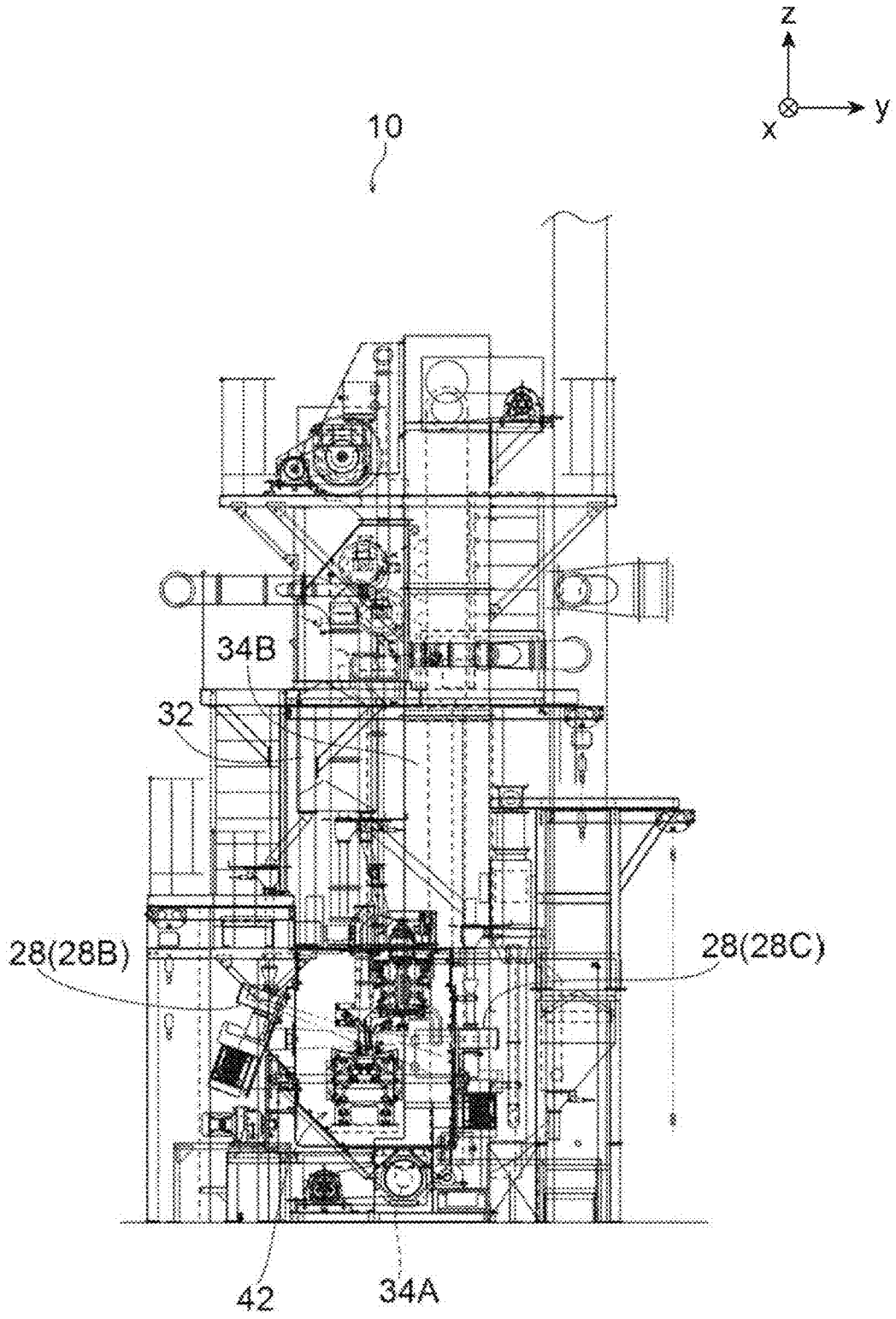
FIG. 3 is a front view illustrating the shot blasting device according to an embodiment.
Figure 4:
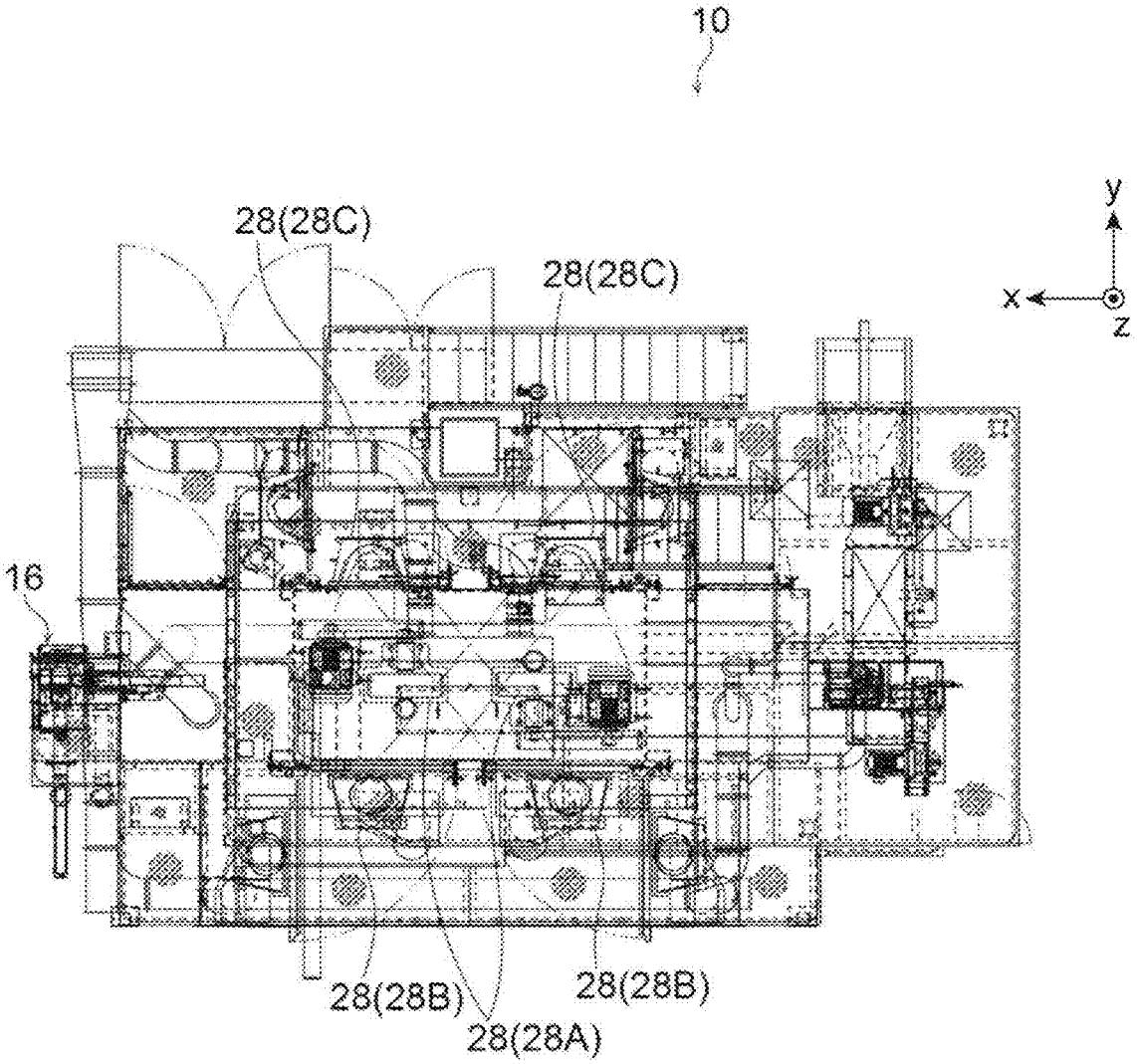
FIG. 4 is a plan view illustrating the shot blasting device according to an embodiment.
Figure 10:
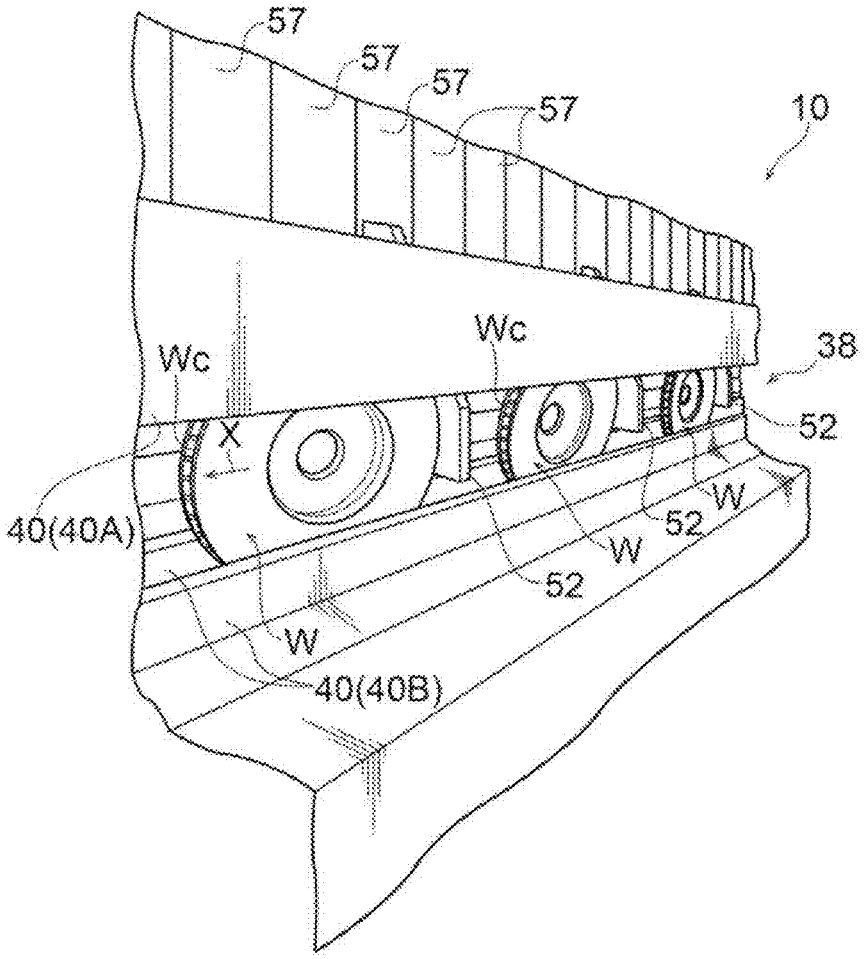
FIG. 10 is a perspective view illustrating a state in which a workpiece is rotated and conveyed by the shot blasting device of FIG. 1, where
Figure 10:
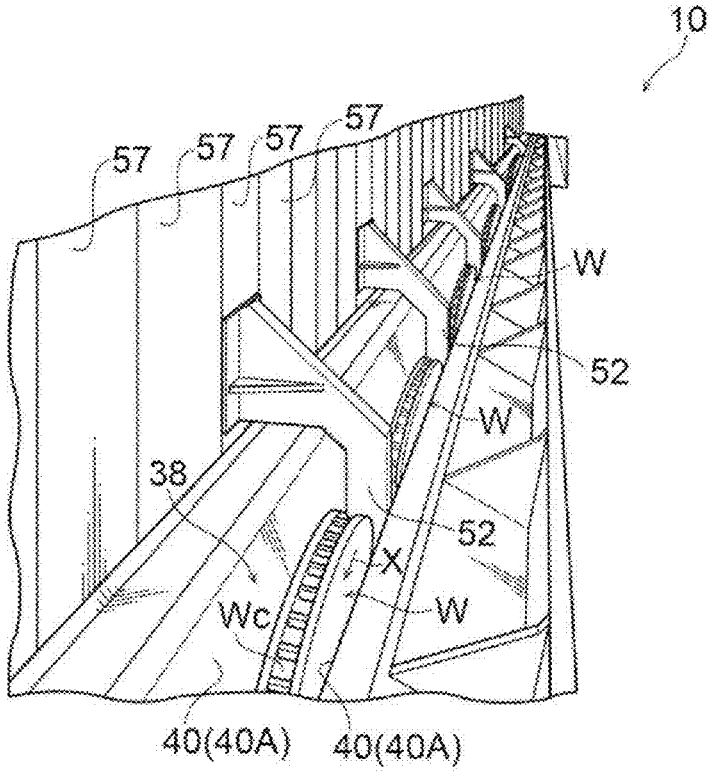

FIG. 1 is a side view of a shot blasting device 10 which is a shot processing device according to an embodiment and FIG. 2 is a side view illustrating a lower part of the shot blasting device 10 of FIG. 1 in a partially enlarged state. Further, FIG. 3 is a front view of the shot blasting device 10 and FIG. 4 is a plan view of the shot blasting device 10. A workpiece W (see FIG. 2) which is shot-blasted in the shot blasting device 10 according to the embodiment is a disk-shaped disk rotor. As illustrated in FIG. 10, a through-hole Wc is formed at the outer peripheral portion of the workpiece W and the shot blasting device 10 also performs shot blasting on the through-hole Wc.

Figure 5:
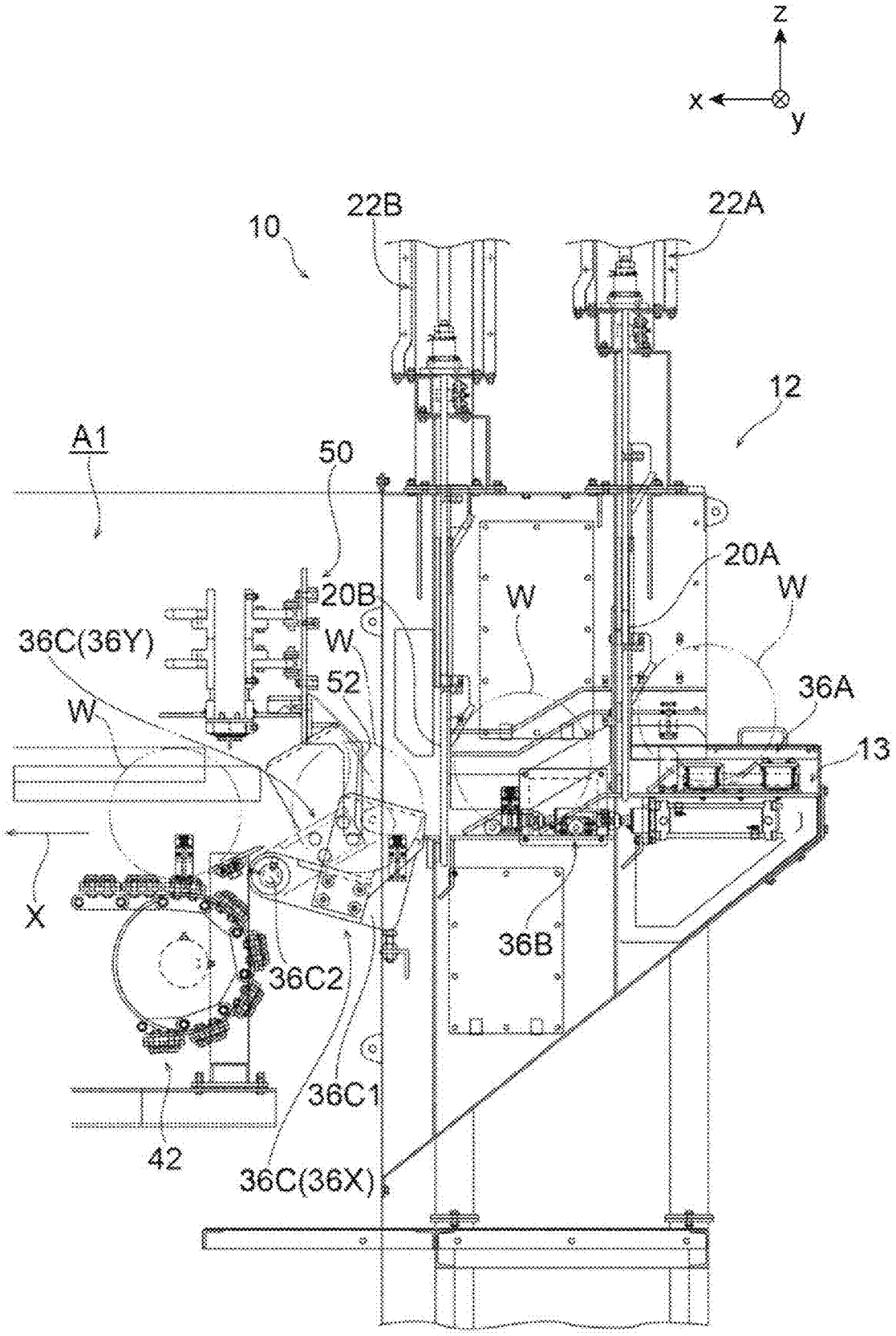
FIG. 5 is a side view illustrating a loading side mechanism of the shot blasting device of FIG. 1 in a partially enlarged state.
Figure 6:
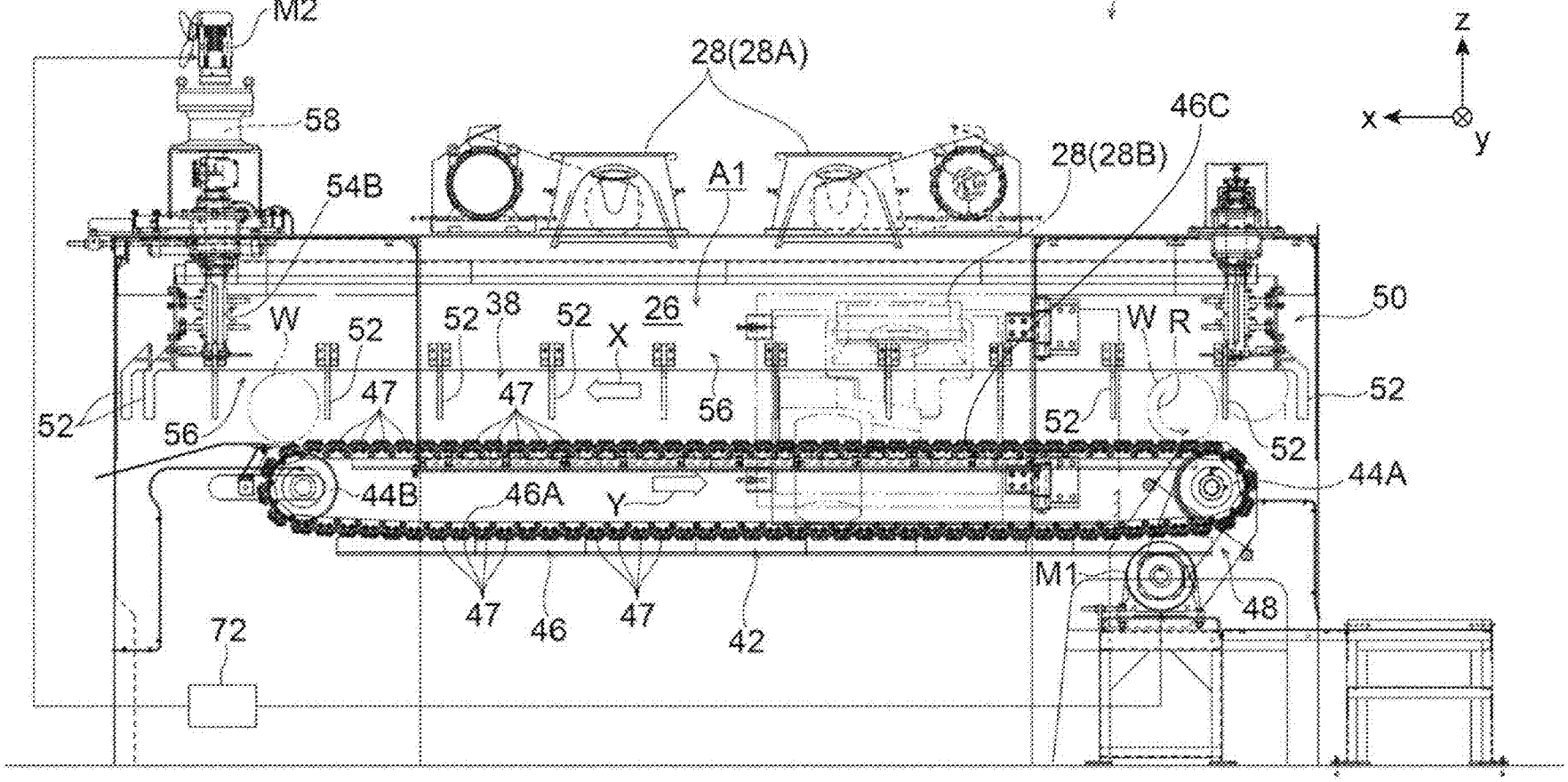
FIG. 6 is a side view illustrating a main part of the shot blasting device of FIG. 1 in a simplified and enlarged state.
Figure 7:
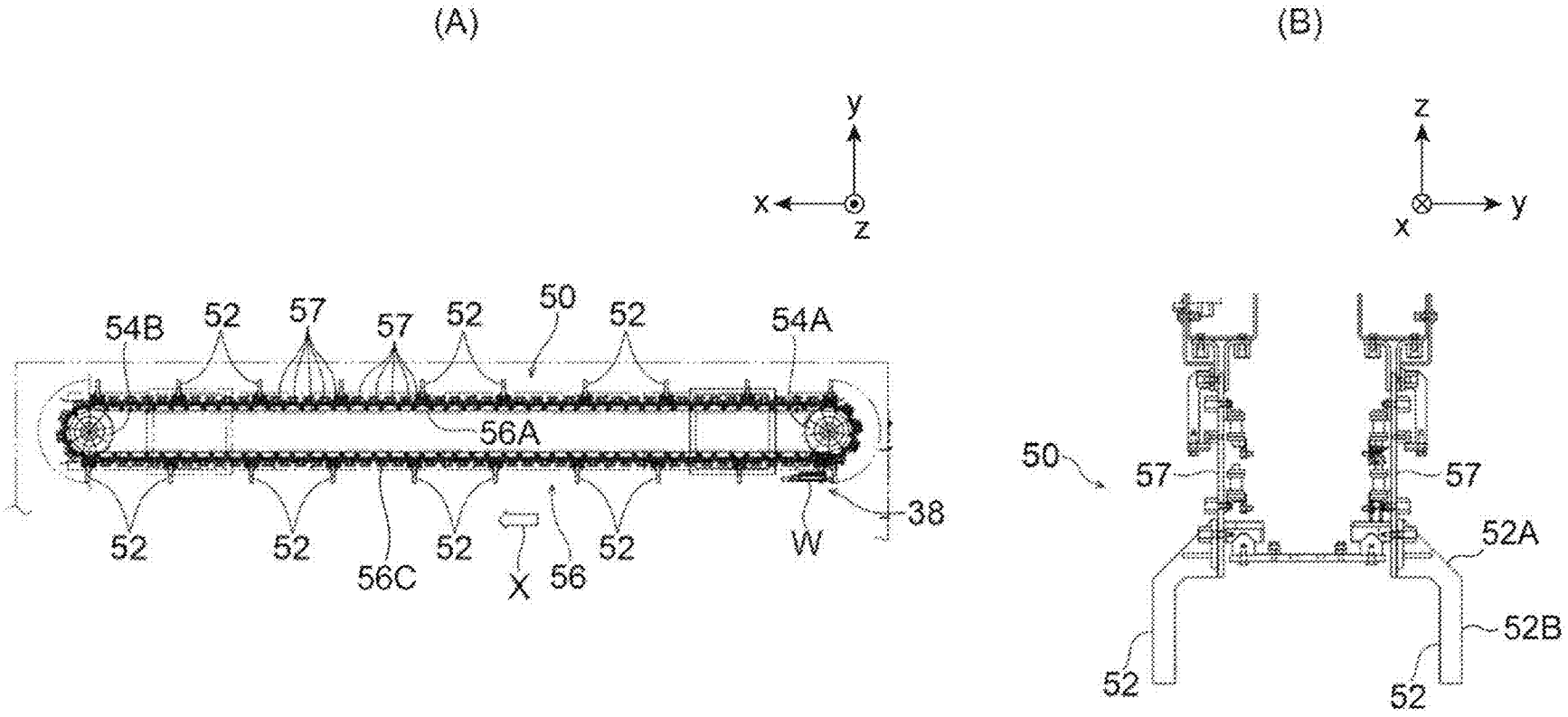
FIG. 7 is an enlarged view of a conveyance mechanism of the shot blasting device of FIG. 1, where

The shot blasting device 10 is a device which projects shot media to the workpiece W while conveying the workpiece W in a conveyance direction (a direction indicated by an arrow X of FIG. 6). The conveyance direction of the workpiece W matches a direction from the front side to the rear side of the shot blasting device 10, that is, the x direction. As illustrated in FIG. 2, the shot blasting device 10 includes a cabinet 12. Furthermore, in FIGS. 1 to 6, for convenience of description, a part of components inside the cabinet 12 are illustrated in a state in which a wall of the cabinet 12 is appropriately seen through. As illustrated in FIG. 2, the cabinet 12 is formed such that the conveyance direction of the workpiece W (the direction of the arrow X) is the longitudinal direction. The cabinet 12 is provided with a loading port 14 which is formed at the upstream side (the right side of the drawing) in the conveyance direction of the workpiece W so as to load the workpiece W thereto and an unloading port 16 (see FIG. 4) which is formed at the downstream side (the left side of the drawing) in the conveyance direction of the workpiece W so as to unload the workpiece W therefrom. The loading port 14 allows a space in front of the device (the right side of FIG. 2) to communicate with an internal space of the cabinet 12 and the unloading port 16 (see FIG. 4) allows the internal space of the cabinet 12 to communicate with a space on the right side of the device.

A loading placement table 13 is provided on the front side (the −x direction) in relation to the loading port 14. The loading port 14 is provided with a first elevator door 20A. The first elevator door 20A is opened when the existence of the workpiece W on the placement table 13 is detected by a sensor and is closed when the workpiece W passes through the closing position of the first elevator door 20A. Furthermore, the first elevator door 20A can be opened or closed by operating a touch panel of an operation panel. Further, a second elevator door 20B is provided on the downstream side (the +x direction side) in relation to the first elevator door 20A inside the cabinet 12. Further, a third elevator door 20C is provided on the downstream side (the +x direction side) in relation to the second elevator door 20B inside the cabinet 12. Furthermore, the unloading port 16 is provided with a fourth elevator door 20D. A downstream side in the conveyance direction of the workpiece W in relation to the third elevator door 20C is formed as an unloading chamber 70 for unloading the workpiece W.

Furthermore, hereinafter, the first elevator door 20A, the second elevator door 20B, the third elevator door 20C, and the fourth elevator door 20D will be referred to as the elevator doors 20A to 20D when they are collectively described without being distinguished. The elevator doors 20A to 20D have a structure that moves up and down in the vertical direction by cylinder mechanisms 22A, 22B, 22C, and 22D (hereinafter, referred to as "cylinder mechanisms 22A to 22D") and are raised and opened when the workpiece W pass therethrough. A control device 72 (illustrated as a block in the drawing) is connected to the cylinder mechanisms 22A to 22D and the operations of the cylinder mechanisms 22A to 22D are controlled by the control device 72.

Partition walls 24A and 24B are provided between the second elevator door 20B and the third elevator door 20C inside the cabinet 12. A projection chamber 26 is formed between the partition wall 24A and the partition wall 24B. The projection chamber 26 is a space for performing blasting (shot-projection cleaning and surface processing in a broad sense) on the workpiece W by projecting shot media to the workpiece W.

A conveyance path 38 which is a conveyance route of the workpiece W is formed between the second elevator door 20B and the third elevator door 20C inside the cabinet 12. A plurality of projectors 28 (which are totally six projectors in this embodiment (see FIG. 4)) are attached to the upper side and the lateral side of the conveyance path 38. The projector 28 is, for example, a centrifugal projector and is able to apply a centrifugal force to shot media rotating an impeller. The projector 28 accelerates the shot media by a centrifugal force and projects the shot media to the workpiece W conveyed along the conveyance path 38 (more specifically, the workpiece W conveyed in the projection chamber 26).

Figure 8:
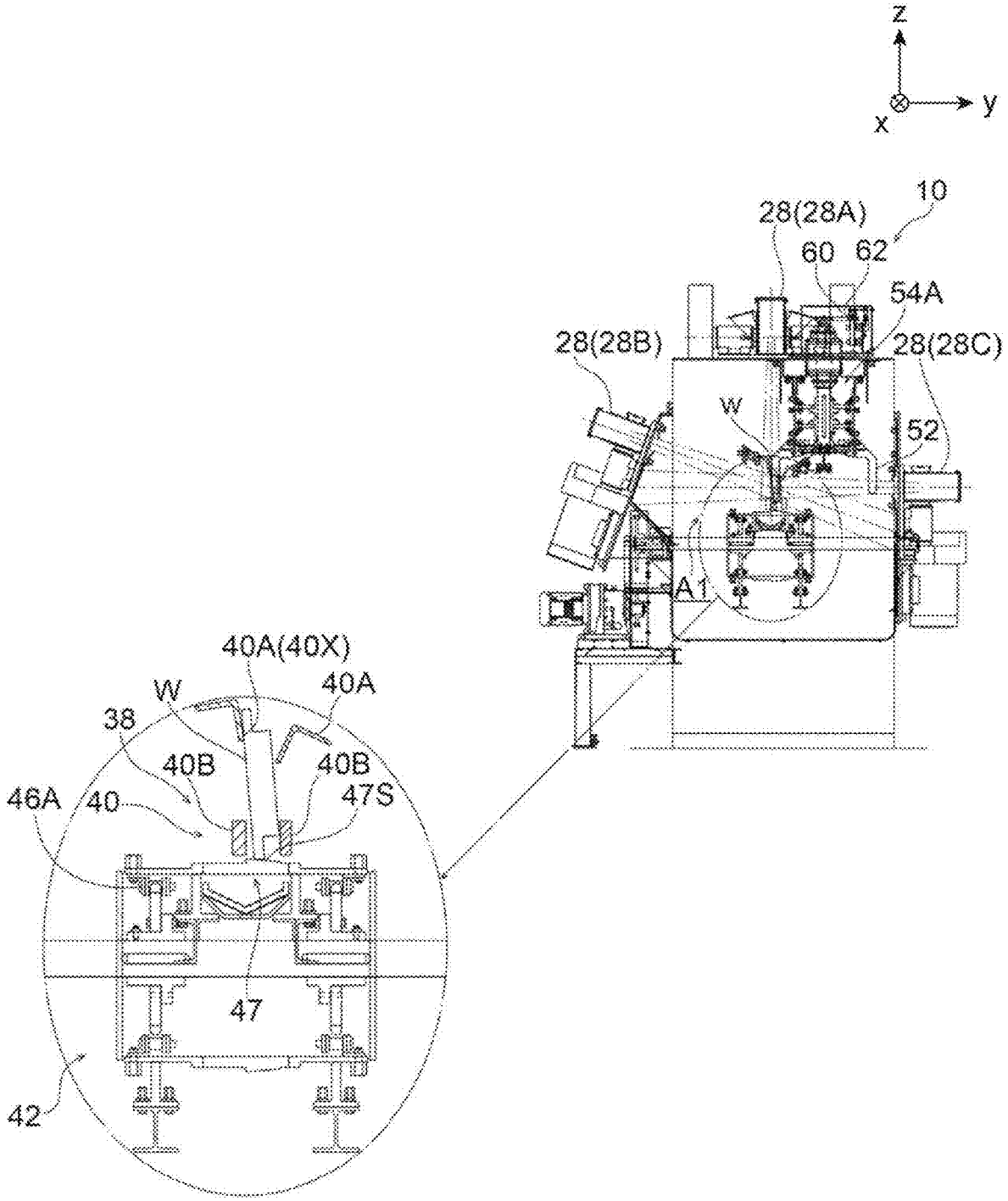
FIG. 8 is a front enlarged cross-sectional view illustrating a state in which a workpiece is shot-blasted by the shot blasting device of FIG. 1.

FIG. 8 is a front enlarged cross-sectional view illustrating a state in which the workpiece W is shot-blasted by the shot blasting device 10. Furthermore, in FIG. 8, for convenience of description, hatching indicating a cross-section is omitted. As illustrated in FIG. 8, in this embodiment, an upper projector 28A, a first lateral projector 28B, and a second lateral projector 28C are included as the projector 28. The upper projector 28A is provided above the conveyance path 38 which is the conveyance route of the workpiece W and the shot media are projected upward toward the outer peripheral side of the workpiece W. The first lateral projector 28B is provided on the lateral side of the conveyance path 38 and projects the shot media from an obliquely upward side toward one side surface of the workpiece W in a standing posture during conveyance. The second lateral projector 28C is provided on the lateral side of the conveyance path 38 and projects the shot media from a lateral side toward the other side surface of the workpiece W in a standing posture during conveyance. Furthermore, in the description below, the upper projector 28A, the first lateral projector 28B, and the second lateral projector 28C will be referred to as the projector 28 when they are collectively described without being distinguished.

Meanwhile, an introduction pipe 29 is disposed above the projector 28 illustrated in FIG. 2. As illustrated in FIG. 1, the upper end of the introduction pipe 29 is connected to a shot tank 32 for storing the shot media through a flow rate adjustment device 30. Further, the projector 28 is connected to a circulation device 34 through the introduction pipe 29, the flow rate adjustment device 30, and the shot tank 32. The circulation device 34 is a device for carrying the shot media projected by the projector 28 and circulating the shot media in the projector 28.

The circulation device 34 includes a first screw conveyor 34A which is provided below the cabinet 12 so as to extend in the front and rear direction of the device (the x direction of FIG. 1) and a bucket elevator 34B (see FIG. 3) which is provided at the lateral side of the downstream side of the first screw conveyor 34A in the conveyance direction so as to stand upward in the device. Further, the circulation device 34 further includes a second screw conveyor 34C which extends from the lateral side of the upper portion of the bucket elevator 34B in the front and rear direction of the device (the x direction of FIG. 1) and a separator 34D which is provided between the second screw conveyor 34C and the shot tank 32.

FIG. 5 is a side view illustrating a part of the loading side of the shot blasting device 10 of FIG. 1 in a partially enlarged state. As illustrated in FIG. 5, a first loading device 36A and a second loading device 36B are provided on the loading side of the cabinet 12. The first loading device 36A is provided on the upstream side (the −x direction side) in relation to the first elevator door 20A. The second loading device 36B is provided between the first elevator door 20A and the second elevator door 20B. The control device 72 (see FIG. 2) is connected to the first loading device 36A and the second loading device 36B and the operations of the first loading device 36A and the second loading device 36B are controlled by the control signal from the control device 72. The first loading device 36A includes a cylinder mechanism and is adapted to push the workpiece W on the placement table 13 in the conveyance direction at a timing in which the first elevator door 20A is opened. The second loading device 36B includes a cylinder mechanism and is adapted to push the workpiece W disposed between the first elevator door 20A and the second elevator door 20B in the conveyance direction at a timing in which the second elevator door 20B is opened.

Further, a third loading device 36C is provided on the loading side inside the cabinet 12 and the downstream side of the second elevator door 20B. The control device 72 (see FIG. 2) is connected to the third loading device 36C and the operation of the third loading device 36C is controlled by the control device 72 (see FIG. 2). The third loading device 36C includes an L-shaped arm 36C1 for throwing out the workpiece W in the conveyance direction. The arm 36C1 is rotatable around a shaft 36C2 in the conveyance width direction and is rotated between a first position (36X) at the time of receiving the workpiece W and a second position (36Y) at the time of throwing out the workpiece W to the downstream side in the conveyance direction in response to the operation of the cylinder mechanism (not illustrated). Then, the third loading device 36C is operated at a predetermined cycle and the arm 36C1 is rotated from the first position (36X) to the second position (36Y) and is rotated (returned) to the first position (36X).

FIG. 10 is a perspective view illustrating a state in which the workpiece W is rotated and conveyed by the shot blasting device 10. FIG. 10(A) is a perspective view seen from diagonally below and FIG. 10(B) is a perspective view seen from diagonally above. As illustrated in FIGS. 10(A) and FIG. 10(B), the shot blasting device 10 further includes a guide portion 40 which is provided along the conveyance direction of the workpiece W. In an embodiment, the guide portion 40 includes a pair of upper guide rails 40A and a pair of lower guide rails 40B. The pair of upper guide rails 40A extends in the conveyance direction of the workpiece W, that is, the x direction and separates from each other in the y direction with the conveyance path 38 interposed therebetween. The pair of upper guide rails 40A is provided at a height position corresponding to the upper portion of the workpiece W and guides the workpiece W so that the workpiece W is conveyed in the conveyance direction. The pair of lower guide rails 40B also extends in the conveyance direction of the workpiece W, that is, the x direction and separates from each other in the y direction with the conveyance path 38 interposed therebetween. The pair of lower guide rails 40B is provided at a height position corresponding to the lower portion of the workpiece W and guides the workpiece W so that the workpiece W is conveyed in the conveyance direction. In an embodiment, as illustrated in a partially enlarged view of FIG. 8, the guide portion 40 may support the workpiece W in an inclined state in the y direction (in this embodiment, as an example, the left side of the device) perpendicular to the conveyance direction and the vertical direction.

FIG. 6 is a side view illustrating a main part of the shot blasting device 10 in an enlarged state. As illustrated in FIG. 6, the shot blasting device 10 further includes a rotation mechanism 42. The rotation mechanism 42 is provided below the conveyance path 38 and includes a sprocket 44A, a sprocket 44B, a chain 46A, a first endless belt 46, and a motor M1 (a first drive unit). The sprockets 44A and 44B are rotatable around an axis extending in the y direction. The first endless belt 46 is stretched over the sprockets 44A and 44B through the chain 46A so as to have a loop shape when viewed from the y direction. The first endless belt 46 provides a placement surface 46C formed so that the workpiece W is placed on the upper surface thereof. That is, the placement surface 46C provides the conveyance path 38 along which the workpiece W is conveyed.

The motor M1 is connected to the sprocket 44A disposed on the upstream side through a drive force transmission mechanism 48. The control device 72 is connected to the motor M1 and the operation of the motor M1 is controlled by the control device 72. When the motor M1 is operated by the control signal from the control device 72, the sprocket 44A rotates and the first endless belt 46 rotates so that the placement surface 46C of the first endless belt 46 moves in a direction (the direction of the arrow Y) opposite to the conveyance direction of the workpiece W (the direction of the arrow X).

In an embodiment, the first endless belt 46 may include a plurality of steel plate-shaped members 47. The plurality of plate-shaped members 47 are attached to the chain 46A so as to be arranged along the outer periphery of the chain 46A. As illustrated in a partially enlarged view of FIG. 8, a surface 47S of the plate-shaped member 47 constituting the outer peripheral surface of the first endless belt 46 may be inclined with respect to the horizontal plane in the y direction. That is, the surface 47S of the plate-shaped member 47 is located at the upper portion of the first endless belt 46 having a loop shape and is inclined downward from one side (in this embodiment, the left side of the device) of the conveyance width direction corresponding to the inclination side of the workpiece W toward the other side (in this embodiment, the right side of the device) of the conveyance width direction in a state in which the workpiece W can be placed.

As illustrated in FIG. 6, the shot blasting device 10 further includes a conveyance mechanism 50. The conveyance mechanism 50 is provided above the rotation mechanism 42 and pushes the workpiece W toward the conveyance direction so that the workpiece W on the placement surface 46C is rolled and moved along the guide portion 40 in the conveyance direction. FIG. 7(A) is a plan view of the conveyance mechanism 50 and FIG. 7(B) is a front cross-sectional view illustrating the conveyance mechanism 50 in an enlarged state. Furthermore, in FIG. 7(B), hatching indicating a cross-section is omitted.

As illustrated in FIG. 7(A), the conveyance mechanism 50 includes a sprocket 54A, a sprocket 54B, a chain 56A, a second endless belt 56, and a motor M2 (a second drive unit). The sprockets 54A and 54B are rotatable around an axis extending in the z direction. The second endless belt 56 is provided above the placement surface 46C and is stretched over the sprockets 54A and 54B through the chain 56A so as to have a loop shape when viewed from the z direction. The second endless belt 56 is disposed at a position (the right side of the device) shifted in the y direction along the conveyance path 38 and includes a conveyance surface 56C located above the conveyance path 38.

The motor M2 is connected to the sprocket 54B disposed on the conveyance downstream side through a drive force transmission mechanism 58. The control device 72 is connected to the motor M2 and the operation of the motor M2 is controlled by the control device 72. When the motor M2 is operated by the control signal from the control device 72, the sprocket 54B rotates and the second endless belt 56 rotates. At this time, the second endless belt 56 is rotationally driven so that the conveyance surface 56C moves in a direction parallel to the conveyance direction of the workpiece W (the direction of the arrow X). Furthermore, FIG. 6 illustrates the sprocket 54B in a state in which the second endless belt 56 is seen through.

In an embodiment, as illustrated in FIG. 7(A), the second endless belt 56 may include a plurality of steel plate-shaped members 57. As illustrated in FIGS. 6 and 10, the plurality of plate-shaped members 57 are attached to the chain 56A so as to be arranged along the outer periphery of the chain 56A. Furthermore, in FIG. 6, the boundary portion of the plurality of plate-shaped members 57 is omitted in order to simplify the drawing. Further, as illustrated in FIGS. 7(A) and 10(B), the conveyance mechanism 50 further includes a plurality of pushing portions 52 which are arranged along the outer peripheral surface of the second endless belt 56. One ends of the plurality of pushing portions 52 are connected to the plurality of plate-shaped members 57 of the second endless belt 56. Furthermore, one pushing portion 52 may be connected to several plate-shaped members 57. That is, as illustrated in FIG. 7(A), a plurality of pushing portions 52 are provided in the second endless belt 56 at intervals in the circumferential direction. In an embodiment, as illustrated in FIG. 7(B), the pushing portion 52 is formed in an inverse L-shape including a first portion 52A extending in the y direction and a second portion 52B extending in the −z direction (downward). The second portion 52B is adapted to move between the pair of upper guide rails 40A in accordance with the movement of the conveyance surface 56C. Thus, the pushing portion 52 extends downward from the second endless belt 56 and the lower portion thereof contacts the workpiece W disposed in the conveyance path 38.

As described above, since the pushing portion 52 pushes the workpiece W in the conveyance direction as the conveyance surface 56C of the conveyance mechanism 50 moves in a direction parallel to the conveyance direction, the workpiece W moves toward the conveyance direction (the direction of the arrow X). At this time, since the placement surface 46C of the rotation mechanism 42 moves toward a direction (the direction of the arrow Y) opposite to the conveyance direction, the workpiece W disposed on the placement surface 46C moves in a standing state while rolling on the placement surface 46C in the conveyance direction. Hereinafter, an area provided with the rotation mechanism 42 and the conveyance mechanism 50 will be referred to as a rotation conveying area A1. Furthermore, the third loading device 36C illustrated in FIG. 5 and provided on the upstream side of the conveyance direction in relation to the rotation conveying area A1 is a loading mechanism which loads the workpiece W onto the most upstream side of the rotation conveying area A1, that is, the placement surface 46C.

A speed of rotationally driving the second endless belt 56 by the control device 72 is controlled so that one of the plurality of pushing portions 52 is disposed at a position in which the workpiece W loaded onto the placement surface 46C can be pushes in the conveyance direction in accordance with a timing in which the third loading device 36C loads the workpiece W onto the most upstream side of the rotation conveying area A1, that is, the placement surface 46C. The control device 72 rotationally drives the second endless belt 56 at a constant speed.

A steel bar 60 which protrudes in the radial direction of the shaft of the sprocket 54A is fixed to the upper end portion of the rotation shaft of the driven sprocket 54A disposed on the conveyance upstream side illustrated in FIG. 8. Further, a proximity switch 62 is disposed in the vicinity of the bar 60.

The proximity switch 62 is configured to turn on an electric circuit (a control circuit) including the proximity switch 62 when the bar 60 approaches a predetermined range. That is, the proximity switch 62 is configured to detect the approaching of the bar 60. Then, in this embodiment, when one of the plurality of pushing portions 52 reaches a predetermined position on the most upstream side of the rotation conveying area A1 illustrated in FIG. 5, the proximity switch 62 illustrated in FIG. 8 is set to detect the approaching of the bar 60. The proximity switch 62 is connected to the control device 72 (see FIG. 2) and outputs a detection signal to the control device 72 (see FIG. 2). Further, when the proximity switch 62 detects the approaching of the bar 60, the control device 72 (see FIG. 2) operates the cylinder mechanism 22B illustrated in FIG. 5 so that the second elevator door 20B is opened and the second loading device 36B pushes the workpiece W toward the upper side of the arm 36C1 of the third loading device 36C.

FIG. 9(A) is a rear view illustrating a part of the unloading side mechanism of the shot blasting device 10 and FIG. 9(B) is a side view illustrating a part of the unloading side mechanism of the shot blasting device 10. As illustrated in FIG. 9(B), a slope 64 is provided in an unloading side area A2 which is continuous to the unloading side of the rotation conveying area A1 and the workpiece W rolls in a standing posture.

A sensor S1 which detects the workpiece W reaching the front side of the third elevator door 20C (the right side of FIG. 9(B)) is provided in the vicinity of the third elevator door 20C. The sensor S1 is connected to the control device 72 (see FIG. 2) and outputs a detection signal to the control device 72 (see FIG. 2). When the sensor S1 detects that the workpiece W reaches the front side of the third elevator door 20C, the control device 72 controls the operation of the cylinder mechanism 22C so that the third elevator door 20C is opened.

As illustrated in FIG. 9(A), an extrusion plate 65 and a contact member 66 are provided inside the unloading chamber 70 corresponding to the unloading side of the conveyance path 38. The extrusion plate 65 is provided on a plane orthogonal to the y direction and is disposed on the lateral side (the left side of the device) with respect to the workpiece W disposed inside the unloading chamber 70. The contact member 66 is attached to the upper portion of the extrusion plate 65 through an attachment member and extends from the extrusion plate 65 to the lateral side of the workpiece W (the right side of the device) disposed inside the unloading chamber 70. The contact member 66 is a bar-shaped member that is bent in a substantially U-shape and is disposed so that the lower side of the device is opened when the device is viewed from the rear side. The contact member 66 is provided on the downstream side of the conveyance direction of the workpiece W with respect to the guide portion 40 (see FIG. 9(B)) and includes an abutting portion 66A which contacts the upper portion of the workpiece W from the side (the right side of the device) in a standing posture disposed in the unloading chamber 70.

Further, a bracket 67A having an L-shaped cross-section is attached to a surface of the extrusion plate 65 on the left side of the device and a vehicle wheel 67B for smoothing the movement in the conveyance width direction is attached to the lower edge portion of the bracket 67A. Further, a front end portion of a rod portion 68A of a cylinder mechanism 68 which is a movement mechanism is connected to a surface of the bracket 67A on the left side of the device. Accordingly, the abutting portion 66A is movable so as to cross the conveyance path 38 in the conveyance width direction, that is, in the y direction. Further, the abutting portion 66A is set to be disposed on the right side of the device with respect to the workpiece W at a timing in which the workpiece W is disposed in the unloading chamber 70.

The cylinder mechanism 68 is a known cylinder mechanism. The control device 72 is connected to the cylinder mechanism 68 and the operation of the cylinder mechanism 68 is controlled by the control device 72. The rod portion 68A of the cylinder mechanism 68 is disposed on the lateral side of the conveyance path 38 (the left side of the device) so that the conveyance width direction is the axial direction. Accordingly, the cylinder mechanism 68 is operated so that the extrusion plate 65 and the contact member 66 move in the y direction. Furthermore, in the drawings, the extrusion plate 65, the contact member 66, the bracket 67A, and the vehicle wheel 67B moving to the left side of the device are indicated by a two-dotted chain line.

As illustrated in FIG. 9(B), a sensor S2 which detects the workpiece W disposed at a predetermined position of the unloading chamber 70 is provided above the unloading chamber 70. The sensor S2 is connected to the control device 72 (see FIG. 2) and outputs a detection signal to the control device 72 (see FIG. 2). The control device 72 (see FIG. 2) controls the operation of the cylinder mechanism 68 so that the abutting portion 66A illustrated in FIG. 9(A) contacts the workpiece W in a conveying posture from the right side of the device and the workpiece moves to the left side of the device at a timing in which the workpiece W is disposed at the predetermined position of the unloading chamber 70 on the basis of the detection signal of the sensor S2. Accordingly, the workpiece W in the conveying posture falls down to the left side of the device. Further, the control device 72 (see FIG. 2) controls the operation of the cylinder mechanism 22D (see FIG. 2) so that the fourth elevator door 20D is opened and controls the operation of the cylinder mechanism 68 so that the extrusion plate 65 moves to the right side of the device at a timing in which the workpiece W falls down. Accordingly, the workpiece W having fallen down is unloaded from the unloading port 16.

Operation and Effect of Embodiment

Next, an operation and an effect of the above-described embodiment will be described.

As illustrated in FIG. 10, in the shot blasting device 10, the guide portion 40 is provided on both sides in the y direction of the conveyance path 38 corresponding to the conveyance route of the workpiece W. The guide portion 40 guides the workpiece W so that the workpiece W in a standing posture is conveyed in the conveyance direction (the direction of the arrow X). Further, the rotation mechanism 42 is provided below the conveyance path 38. The rotation mechanism 42 includes the first endless belt 46 having a loop shape when viewed from the y direction and the first endless belt 46 is rotationally driven so that the workpiece W in a standing posture is placed on the placement surface 46C and the placement surface 46C moves in a direction (the direction of the arrow Y) opposite to the conveyance direction (the direction of the arrow X). In a state in which the first endless belt 46 is rotationally driven, the workpiece W on the first endless belt 46 is conveyed by the pushing portion 52 of the conveyance mechanism 50 in the conveyance direction (the direction of the arrow X). Accordingly, the workpiece W rolls and moves in the conveyance direction while rotating at a desired rotation speed (in the direction of the arrow R). The shot media are projected from the projector 28 to the workpiece W rolling and moving on the placement surface 46C. Thus, it is possible to project the shot media to the workpiece W while rotating the workpiece W without stopping the conveyance of the workpiece W.

In the shot blasting device 10 according to the above-described embodiment, since the workpiece W can be conveyed while rotating at a desired rotation speed, it is possible to suppress the length of the projection chamber 26 in the conveyance direction of the workpiece W and to suppress unnecessary hitting of the shot media by the projector 28.

Further, in the shot blasting device 10, as illustrated in FIG. 7(A), the second endless belt 56 of the conveyance mechanism 50 disposed on the lateral side of the conveyance path 38 and having a loop shape when viewed from the z direction is rotationally driven. A plurality of pushing portions 52 are provided in the second endless belt 56 at intervals in the circumferential direction. Meanwhile, the third loading device 36C illustrated in FIG. 5 is operated at a predetermined cycle so that the workpiece W is loaded into the most upstream side of the rotation conveying area A1 of the rotation mechanism. Here, a speed of rotationally driving the second endless belt 56 is set so that one of the plurality of pushing portions 52 is disposed at a position in which the workpiece W can be pushed on the most upstream side of the rotation conveying area A1 in accordance with a timing in which the third loading device 36C loads the workpiece W into the most upstream side of the rotation conveying area A1. Thus, it is possible to efficiently and sequentially push and convey the workpiece W, loaded into the most upstream side of the rotation conveying area A1 by the third loading device 36C, by the pushing portions 52 illustrated in FIG. 6.

In the shot blasting device 10, as illustrated in FIG. 8, the upper projector 28A projects the shot media from the upper side toward the outer peripheral side of the workpiece W. Further, as illustrated in a partially enlarged view of FIG. 8, the guide portion 40 supports the workpiece W while being inclined in the y direction (in this embodiment, the left side of the device). For this reason, since the workpiece W hardly flaps left and right when the shot media are projected from the upper projector 28A to the workpiece W, it is possible to satisfactorily blast the through-hole Wc on the outer peripheral side of the workpiece W. Furthermore, for example, when the outer peripheral side of the workpiece W is provided with a concave portion instead of the through-hole Wc, the concave portion can be satisfactorily blasted.

Further, in this embodiment, as illustrated in FIG. 6, the first endless belt 46 includes a plurality of steel plate-shaped members 47 which are provided in parallel in the circumferential direction and constitutes the outer peripheral surface of the first endless belt 46. For this reason, the consumption of the first endless belt 46 due to the projection of the shot media are suppressed as compared with, for example, a case in which the first endless belt 46 is formed of rubber.

Further, in this embodiment, as illustrated in a partially enlarged view of FIG. 8, the surface 47S of the plate-shaped member 47 is inclined with respect to the horizontal plane in the y direction. Thus, a force that slides on the inclined surface 47S of the steel plate-shaped member 47 acts on the workpiece W due to the own weight. Accordingly, since the workpiece W tends to lean on the upper guide rail 40A of the guide portion 40, the workpiece W hardly falls down to the side (in this embodiment, the right side of the device) opposite to the inclination side and hence the posture of the workpiece W can be stably maintained.

Further, in this embodiment, the contact member 66 and the cylinder mechanism 68 illustrated in FIG. 9(A) are provided on the unloading side of the conveyance path 38. The abutting portion 66A of the contact member 66 is provided on the downstream side in the conveyance direction of the workpiece W with respect to the guide portion 40 (see FIG. 9(B)), is disposed so as to be movable in the conveyance path 38 in the y direction, and is able to contact the upper portion of the workpiece W in a standing posture on the unloading side of the conveyance path 38 from the lateral side. Further, the cylinder mechanism 68 moves the abutting portion 66A in the conveyance width direction. Accordingly, since the cylinder mechanism 68 moves the abutting portion 66A disposed on the lateral side with respect to the upper portion of the workpiece W in a standing posture on the unloading side of the conveyance path 38, the abutting portion 66A can press down the workpiece W. As a result, the shot media adhering to the workpiece W can be dropped from the workpiece W.

Hereinafter, a shot processing method of projecting the shot media to the workpiece W while conveying the disk-shaped workpiece W will be described.

Figure 11:
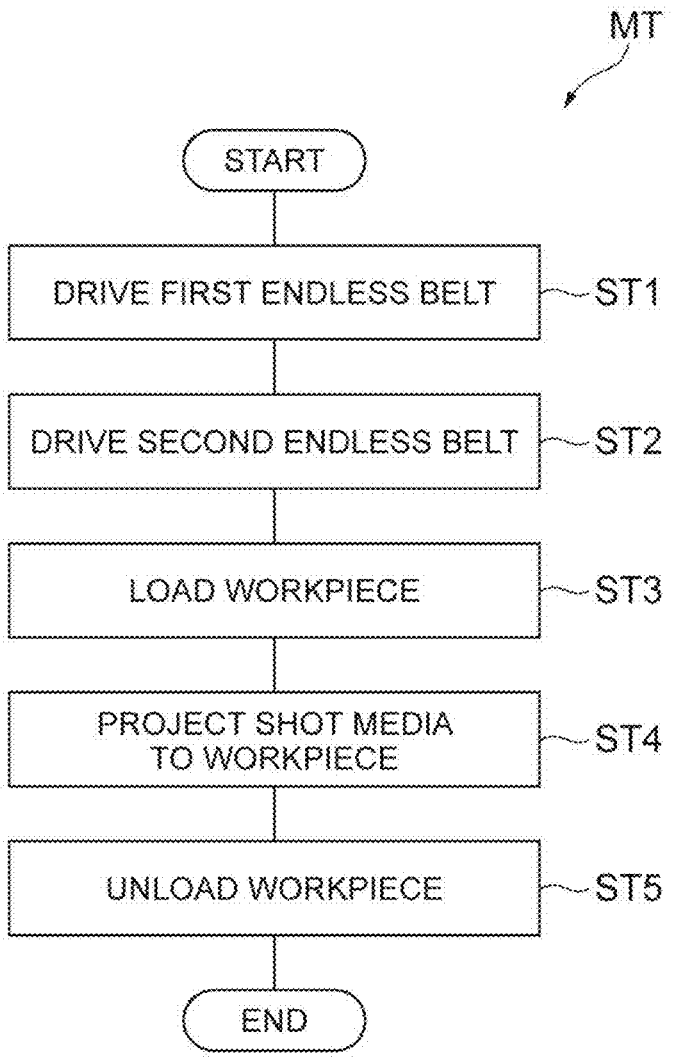
FIG. 11 is a flowchart illustrating a shot processing method according to an embodiment.

FIG. 11 is a flowchart illustrating a shot processing method MT of an embodiment. In the method MT, the shot media are projected to the workpiece by using the shot blasting device 10 illustrated in FIG. 1. In the method MT, first, step ST1 is performed. In step ST1, the first endless belt 46 is driven so that the placement surface 46C moves in a direction (the direction of the arrow Y) opposite to the conveyance direction of the workpiece W (the direction of the arrow X). In next step ST2, the second endless belt 56 is driven so that the conveyance surface 56C of the conveyance mechanism 50 moves in the conveyance direction of the workpiece W (the direction of the arrow X). Accordingly, the plurality of pushing portions 52 provided in the second endless belt 56 move in the conveyance direction. In next step ST3, the workpiece W is loaded into the conveyance path 38 of the shot blasting device 10. Specifically, the outer peripheral side of the workpiece W is placed on the placement surface 46C of the first endless belt 46 by the first loading device 36A, the second loading device 36B, and the third loading device 36C. The workpiece W placed on the placement surface 46C is pushed in the conveyance direction by one pushing portion 52 of the plurality of pushing portions 52, so that the workpiece W on the placement surface 46C moving in a direction opposite to the conveyance direction rolls and moves in the conveyance direction along the guide portion 40. In next step ST4, the shot media are projected from the projector 28 to the workpiece W rolling and moving on the placement surface 46C. Accordingly, the surface of the workpiece W is processed. In next step ST5, the workpiece W of which the surface has been processed is conveyed to the unloading chamber 70 and is unloaded from the shot blasting device 10. Furthermore, in an embodiment, the workpiece W may fall down to the lateral side in such a manner that the abutting portion 66A is moved so as to contact the upper portion of the workpiece W from the lateral side at the time of unloading the workpiece W.

As described above, according to this embodiment, there is an excellent effect that the shot media can be projected toward the workpiece W while the workpiece W is rotated and conveyed at a desired rotation speed in a standing state.

Supplementary Description of Embodiment

Furthermore, in the shot blasting device 10 and the shot processing method of the above-described embodiment, the workpiece W is a disk-shaped disk rotor, but the workpiece may be another disk-shaped product or a bottomed cylindrical product (for example, a drum brake).

Further, in the above-described embodiment, the guide portion 40 illustrated in FIG. 8 and the like supports the workpiece W upward while being inclined to one side in the conveyance width direction, but the guide portion 40 can support the workpiece W in a standing state in the vertical direction.

Further, in the above-described embodiment, the first endless belt 46 illustrated in FIG. 6 and the like includes a plurality of steel plate-shaped members 47 which are provided in parallel in the circumferential direction and constitute the outer peripheral surface of the first endless belt 46, but the first endless belt 46 may be, for example, a rubber endless belt.

Further, in the above-described embodiment, the surface 47S constituting the outer peripheral surface of the first endless belt 46 in the plate-shaped member 47 illustrated in FIG. 8 is located at the upper portion of the first endless belt 46 having a loop shape and is inclined downward from one side of the conveyance width direction corresponding to the inclination side of the workpiece W (in this embodiment, the left side of the device) toward the other side of the conveyance width direction (in this embodiment, the right side of the device) in a state in which the workpiece W can be placed thereon. However, the surface 47S may be located at the upper portion of the first endless belt 46 having a loop shape and may be disposed, for example, in the conveyance width direction (that is, a horizontal direction) in a state in which the workpiece W can be placed thereon.

Figure 9:
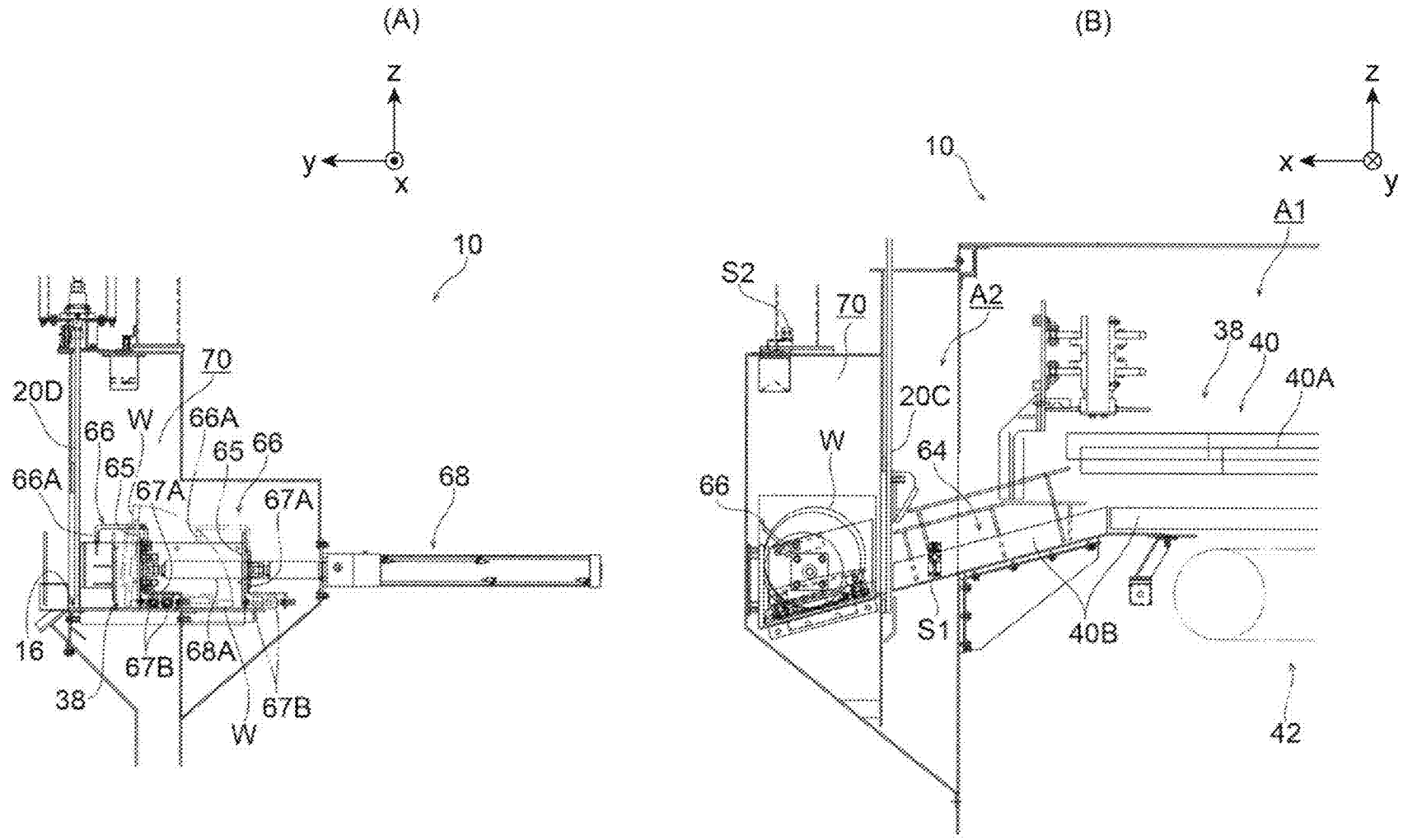
FIG. 9 is a diagram illustrating a part of an unloading side mechanism of the shot blasting device of FIG. 1, where

Further, in the above-described embodiment, the abutting portion 66A and the cylinder mechanism 68 (the movement mechanism) are provided on the unloading side of the conveyance path 38 illustrated in FIG. 9, but the abutting portion 66A and the cylinder mechanism 68 may not be essentially provided.

Further, in the above-described embodiment, the speed of rotationally driving the second endless belt 56 is controlled so that one of the plurality of pushing portions 52 is disposed at a position in which the workpiece W can be pushed on the most upstream side of the rotation conveying area A1 in accordance with a timing in which the third loading device 36C illustrated in FIG. 5 loads the workpiece W into the most upstream side of the rotation conveying area A1, but such control may not be essentially performed.

Further, in the above-described embodiment, the shot processing device is the shot blasting device 10, but the shot processing device can be applied to, for example, an arbitrary shot processing device such as a shot peening device and a shot blasting and shot peening device.

Furthermore, the above-described embodiments and the above-described modified examples may be appropriately combined within a consistent range.

As described above, the shot processing device and the shot processing method according to various embodiments have been described. However, the present invention is not limited to the above-described embodiments and various modifications can be made without changing the gist of the present invention.

REFERENCE SIGNS LIST

10: shot blasting device, 12: cabinet, 28: projector, 28A: upper projector, 36A: first loading device, 36B: second loading device, 36C: third loading device, 38: conveyance path, 40: guide portion, 42: rotation mechanism, 46: first endless belt, 46C: placement surface, 47: plate-shaped member, 47S: surface, 50: conveyance mechanism, 52: pushing portion, 56: second endless belt, 56C: conveyance surface, 66A: abutting portion, 70: unloading chamber, 72: control device, M1: motor, M2: motor, W: workpiece.

The invention claimed is:

1. A shot processing device comprising:

a guide portion to form a conveyance path extending in a conveyance direction of a workpiece, the workpiece having a disk shape or a cylindrical shape;

a rotation mechanism which includes a first endless belt providing a placement surface having the workpiece placed thereon and a first drive unit driving the first endless belt so that the placement surface moves in a direction opposite to the conveyance direction;

a conveyance mechanism which pushes the workpiece toward the conveyance direction so that the workpiece on the placement surface rolls and moves in the conveyance direction along the guide portion; and at least one projector which projects shot media to the workpiece rolling and moving on the placement surface, wherein the guide portion includes a pair of upper guide rails extending in the conveyance direction and spaced apart from each other along the conveyance path, and wherein the at least one projector includes an upper projector that is provided above the conveyance path and projects the shot media toward an outer peripheral portion of the workpiece exposed from between the pair of upper guide rails.

2. The shot processing device according to claim 1, wherein the guide portion is configured to support the workpiece while inclining the workpiece in a direction perpendicular to the conveyance direction and a vertical direction.

3. The shot processing device according to claim 1, wherein the first endless belt includes a plurality of steel plate-shaped members.

4. The shot processing device according to claim 3, wherein each of the plurality of plate-shaped members includes a surface inclined with respect to a horizontal plane in a direction perpendicular to the conveyance direction and the vertical direction.

5. The shot processing device according to claim 1, further comprising:

an unloading chamber to unload the workpiece, wherein the unloading chamber is provided with an abutting portion which is movable in a direction perpendicular to the conveyance direction and the vertical direction and is able to contact an upper portion of the workpiece disposed in the unloading chamber from a lateral side and a movement mechanism which moves the abutting portion in a direction perpendicular to the conveyance direction and the vertical direction.

6. The shot processing device according to claim 1, wherein the conveyance mechanism includes a second endless belt which is provided above the placement surface, a second drive unit which drives the second endless belt, and a plurality of pushing portions which are arranged along an outer peripheral surface of the second endless belt, and wherein each of the plurality of pushing portions extends downward from the second endless belt so as to contact the workpiece and pushes the workpiece in the conveyance direction in response to the driving of the second endless belt so that the workpiece is conveyed toward the conveyance direction.

7. The shot processing device according to claim 6, further comprising:

a loading mechanism which is provided on the upstream side of the conveyance direction in relation to the placement surface and loads the workpiece onto the placement surface at a predetermined cycle; and a control device which adjusts a drive speed of the second endless belt so that one pushing portion of the plurality of pushing portions is disposed at a position in which the workpiece loaded onto the placement surface is able to be pushed in the conveyance direction in accordance with a timing in which the workpiece is loaded onto the placement surface.

8. The shot processing device according to claim 6, wherein the second endless belt is wound around a pair of sprockets, each of the pair of sprockets to rotate around an axis extending in a vertical direction.

9. The shot processing device according to claim 1, wherein each of the pair of upper guide rails has a contact surface in contact with the workpiece conveyed along the conveyance path, and the contact surface of one of the pair of upper guide rails is inclined with respect to the contact surface of the other of the pair of upper guide rails in a cross-sectional view orthogonal to the conveying direction.

10. The shot processing device according to claim 1, wherein the guide portion further includes a pair of lower guide rails extending along the conveyance direction, and wherein the pair of lower guide rails are arranged to be separated downward from the pair of upper guide rails and to be spaced apart from each other along the conveyance path.

11. The shot processing device according to claim 1, wherein the conveyance mechanism includes a second endless belt provided above the placement surface, a second drive unit to drive the second endless belt, and a plurality of pushing portions arranged along an outer peripheral surface of the second endless belt, and wherein each of the plurality of pushing portions extends from the second endless belt to the conveyance path through between the pair of upper guide rails so as to contact the workpiece, and moves in the conveyance direction along between the pair of upper guide rails in response to the drive of the second endless belt to convey the workpiece in the conveyance direction.

12. A shot processing method of projecting shot media to a workpiece using a shot processing device, wherein the shot processing device includes a guide portion to form a conveyance path extending in a conveyance direction of the workpiece, the workpiece having a disk shape or a cylindrical shape, a rotation mechanism which includes an endless belt providing a placement surface having the workpiece placed thereon and a drive unit driving the endless belt, a conveyance mechanism which conveys the workpiece toward the conveyance direction, and at least one projector which projects shot media to the workpiece, wherein the guide portion includes a pair of upper guide rails extending in the conveyance direction and spaced apart from each other along the conveyance path, and wherein the at least one projector includes an upper projector that is provided above the conveyance path, wherein the shot processing method comprises:

driving the endless belt so that the placement surface moves in a direction opposite to the conveyance direction;

pushing the workpiece toward the conveyance direction by the conveyance mechanism so that the workpiece on the placement surface rolls and moves in the conveyance direction along the guide portion; and projecting the shot media from the upper projector toward an outer peripheral portion of the workpiece exposed from between the pair of upper guide rails while the workpiece rolls and moves in the conveyance direction.

13. The shot processing method according to claim 12, wherein the workpiece is rolled and moved along the guide portion in the conveyance direction in a state where the workpiece is inclined in a direction perpendicular to the conveyance direction and a vertical direction.

14. The shot processing method according to claim 12, wherein the conveyance mechanism includes a second endless belt provided above the placement surface, a second drive unit to drive the second endless belt, and a plurality of pushing portions arranged along an outer peripheral surface of the second endless belt, and each of the plurality of pushing portions extends from the second endless belt to the conveyance path through between the pair of upper guide rails, and the plurality of pushing portions moves in the conveyance direction along between the pair of upper guide rails to roll and move the workpiece toward the conveyance direction.

* * * * *